US010315815B2

(12) United States Patent
Bentkovski

(10) Patent No.: US 10,315,815 B2
(45) Date of Patent: Jun. 11, 2019

(54) INGREDIENT DISPENSING SYSTEM FOR DISPENSING AN INGREDIENT INTO A CONTAINER

(71) Applicant: WaterIO Ltd, Ness Ziona (IL)

(72) Inventor: Yakov Bentkovski, Ness Ziona (IL)

(73) Assignee: WATERIO LTD., Ness Ziona (IL)

( * ) Notice: Subject to any disclaimer, the term of this patent is extended or adjusted under 35 U.S.C. 154(b) by 159 days.

(21) Appl. No.: 14/985,494

(22) Filed: Dec. 31, 2015

(65) Prior Publication Data

US 2016/0194125 A1 Jul. 7, 2016

Related U.S. Application Data

(60) Provisional application No. 62/099,177, filed on Jan. 1, 2015.

(51) Int. Cl.
*B65D 51/28* (2006.01)

(52) U.S. Cl.
CPC ..... *B65D 51/2807* (2013.01); *B65D 2217/02* (2013.01); *B65D 2217/04* (2013.01)

(58) Field of Classification Search
CPC ..... B65D 51/2807; B65D 2217/02; B65D 2217/04; B65D 1/023; B65D 47/0838;
(Continued)

(56) References Cited

U.S. PATENT DOCUMENTS

| | | | |
|---|---|---|---|
| 8,590,753 | B2 | 11/2013 | Marina et al. |
| 2010/0000960 | A1 | 1/2010 | Anderson |
| 2010/0012193 | A1 | 1/2010 | Anson et al. |
| 2010/0200593 | A1 | 8/2010 | Lazar |
| 2016/0159632 | A1* | 6/2016 | Wheatley ..... G06F 19/3475 222/1 |

FOREIGN PATENT DOCUMENTS

| | | | |
|---|---|---|---|
| WO | WO 2013/173470 | A1 | 11/2013 |
| WO | WO 2015/069916 | A1 | 5/2015 |
| WO | WO 2015/148183 | A1 | 10/2015 |
| WO | WO 2016/145027 | A1 | 9/2016 |

OTHER PUBLICATIONS

FuelPods loading into the LifeFuels Smart Water Bottle LifeFuels, Aug. 21, 2015, <https://www.youtube.com/watch?v=jBAOO4aRTIY> (link no longer available; see attached printout).

(Continued)

*Primary Examiner* — Steven A. Reynolds
*Assistant Examiner* — James M Van Buskirk
(74) *Attorney, Agent, or Firm* — Pearl Cohen Zedek Latzer Baratz LLP

(57) ABSTRACT

Disclosed is an ingredient dispensing system for dispensing an ingredient into a container. The ingredient dispensing system communicates with a computing device over a communication network. The container includes a neck and stores material. The ingredient dispensing system includes a cap, a printed circuit board, a controller, a dispenser, a battery, a battery holder and a housing unit. The controller is connected to the printed circuit board and is further programmed to release signals. The dispenser connected to the printed circuit board dispenses the ingredient on receiving the signal from the controller. The housing unit includes a compartment for storing supplements and a nozzle to release stored supplements through the neck on receiving pressure from the dispenser into the container. Further, the ingredient dispensing system includes a collector assembly for receiving ingredients from the nozzle.

7 Claims, 5 Drawing Sheets

(58) Field of Classification Search
CPC ..... B65D 47/0833; B65D 47/0804; B65D 47/08; B65D 47/06; B65D 51/18; B65D 51/16; B65D 50/043; B65D 51/245; B65D 1/0246; B65D 51/248; G06F 19/3462; G06F 19/3418; G06F 23/263; G06F 23/296; G06F 23/26; G06F 23/2962; A47G 19/2272; A47G 23/16; A61J 7/0481; A61J 7/0436; G01F 23/263; G01F 23/296; G01F 23/26; G01F 23/2962; H04Q 9/00
USPC ..... 141/22, 83, 94, 95, 112, 322; 220/212, 220/810, 836; 206/221; 215/237, 235, 215/228; 360/604; 222/56
See application file for complete search history.

(56) References Cited

OTHER PUBLICATIONS

Meet the LifeFuels Smart Bottle LifeFuels, Aug. 10, 2015 <https://www.youtube.com/watch?v=SRrogMtoo3E> (link no longer available; see attached printout).
Nibletz: the voice of Startups. "LifeFuels Exits Stealth Mode With Smart Water Bottle System" LifeFuels, Jun. 20, 2015 http://www.nibletz.com/news/lifefuels-exits-stealth-mode-smart-water-bottle-system (link no longer available; see attached printout).
International Search Report of PCT Application No. PCT/IL2016/051395, dated Mar. 19, 2017.

* cited by examiner

INGREDIENT DISPENSING SYSTEM FOR DISPENSING AN INGREDIENT INTO A CONTAINER

CROSS REFERENCE TO RELATED APPLICATION

This non-provisional application takes priority from U.S. Provisional Application No. 62/099,177 filed on Jan. 1, 2015 and incorporates the entirety of same by reference herein.

BACKGROUND OF THE INVENTION

1. Field of the Invention

The present invention generally relates to a measurement, reminder and ingredient dispensing system attached with a container, and more specifically relates to an ingredient dispensing system for dispensing an ingredient into a container with ability to communicate data to a communicating device of a user through a communication network.

2. Description of Related Art

Water is crucial for the human being. Every system in the body depends on water. The human body made up of between 55 and 75 percent water, is in need of timely water replenishment. Lack of water can lead to dehydration, a condition that occurs when someone does not have enough water in his/her body to carry on normal functions. Even mild dehydration—as little as a 1 percent to 2 percent loss of the body weight—can exhaust the energy and make a person tired.

Dehydration poses a particular health risk for the very young and the very old. Signs and symptoms of dehydration includes but not limited to excessive thirst, fatigue, headache, dry mouth, little or no urination, muscle weakness, dizziness etc. People seem to carry bottled water everywhere they go. Health practitioners all over the world suggest drinking at least eight glasses of water a day.

There are plenty of other reasons to add supplements to water such as vitamins, minerals, salts, oil etc. The major reasons for drinking water includes maintaining the balance of body fluids, controlling calories, energizing muscles, maintaining skin quality, and helping kidneys.

Further, it is frequently required that the measured amount of supplements is added to a measured amount of the other chemical. Several non-active and active supplements such as medicine, flavors, vitamins, syrup, salts, isotones, food coloring, minerals and nutrients that would be desirable to be added to liquids such as water, juices or other beverages to give the consumer added benefits, particularly those useful for the health of the consumer.

Many foods, medicines, and other substances are often supplied in various forms such as liquid, powder or crystal form and have a limited shelf-life after they have been mixed and stored. Such products are required to be utilized soon after mixing due to various incompatibilities like deterioration, discoloration, interactions and the like. Hence, many beverages are currently sold without the added beneficial ingredients.

In slow release process for better absorption, the ingredients (vitamin) is dispensed into the container and is taken with the fluid over the day. Therefore, there is a need of an ingredient dispensing system for dispensing an ingredient into a container. Further, the ingredient dispensing system receives command from the computing device.

SUMMARY OF THE INVENTION

In accordance with the teachings of the present invention, an ingredient dispensing system for dispensing an ingredient into a container is disclosed.

An object of the present invention is to provide an ingredient dispensing system for dispensing an ingredient into a container. The container contains a neck and stores a material. The ingredient dispensing system communicates with a computing device over a communication network. The ingredient dispensing system includes a cap, a printed circuit board, a controller, a dispenser, a battery, a battery holder and a housing unit.

The cap includes an ergonometric opening for receiving a neck of the container, the cap having an indent parallel to the neck of the container, the printed circuit board placed on the cap parallel to the indent in the cap, the printed circuit board is having a nozzle receiving slot, and the controller connected to the printed circuit board for releasing signals for at least one of the output unit, the dispenser, a first sensor and a second sensor.

The dispenser connected to the printed circuit board dispenses on receiving the signal from the controller, the battery power the controller and the dispenser, the battery holder for holding the battery on the printed circuit board and the housing unit attached to the cap for housing the battery holder, the battery, the dispenser and the printed circuit board.

The housing unit includes a compartment for storing the ingredient and a nozzle protruding from the compartment passes through the nozzle receiving slot and the neck for transferring the ingredient to the container; wherein the dispenser dispenses the ingredient in the compartment to move through the nozzle into the container on receiving processed signals from the controller.

Another object of the present invention is to provide a first sensor connected to the printed circuit board and further disposed in the indent of the cap for sensing the material level inside the container, wherein the controller receives the sensed signals from the first sensor. Another object of the present invention is to provide a second sensor connected to the printed circuit board and further disposed in the indent of the cap for detecting the opening and closing of the ergonometric opening of the cap.

Another object of the present invention is to provide a collector assembly positioned within the neck of the container. The collector assembly receives the ingredient from the nozzle. In order to drink, the user tilts the container resulting in tipping of the ingredient from the collector into the material of the container, and then the user consumes the material with the ingredient through the neck of the container.

These and other features and advantages will become apparent from the following detailed description of illustrative embodiments thereof, which is to be read in connection with the accompanying drawings.

Figure 1:
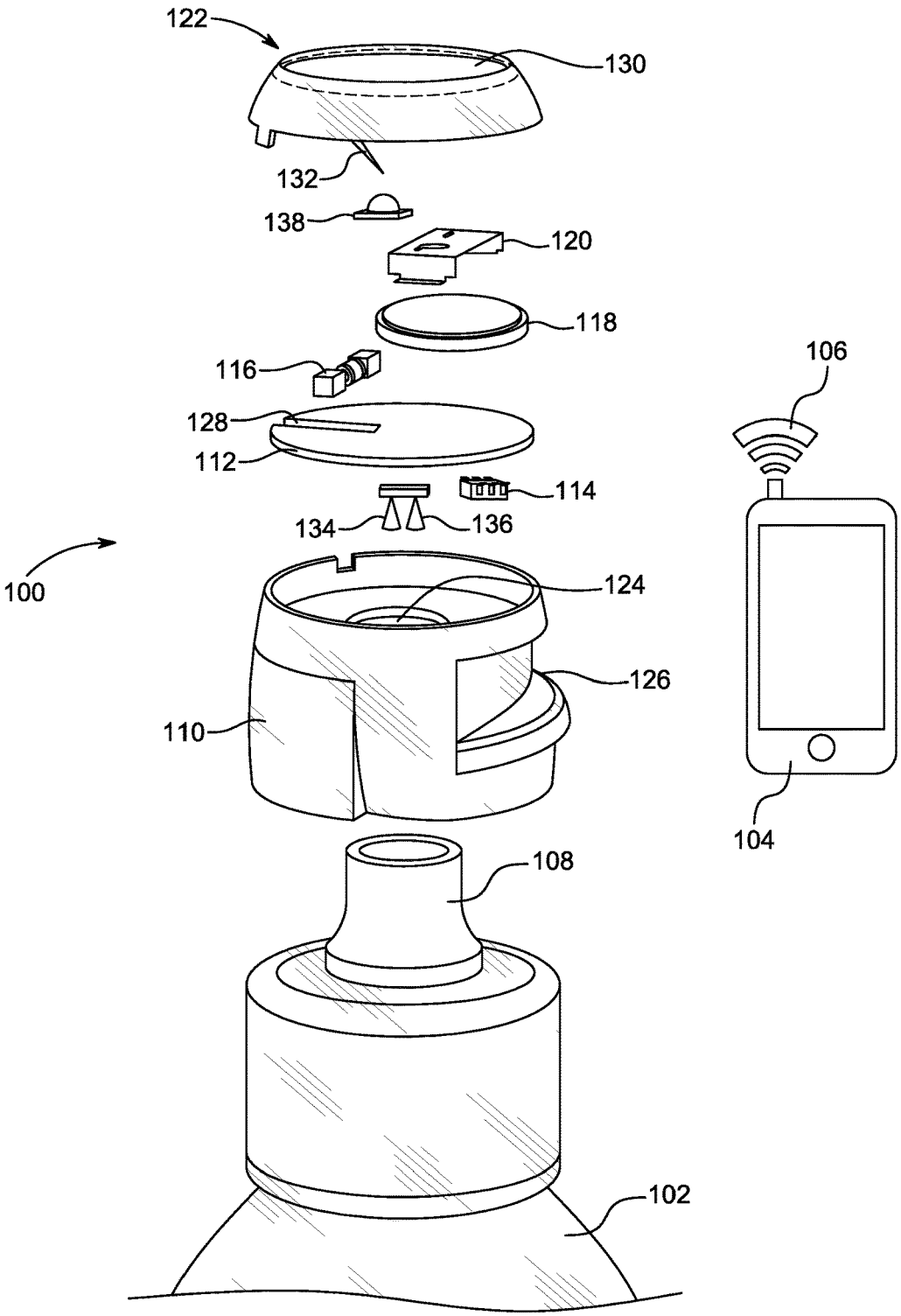
FIG. 1 illustrates an exploded view of an ingredient dispensing system in accordance with a preferred embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

It will be appreciated that for simplicity and clarity of illustration, elements shown in the figures have not necessarily been drawn accurately or to scale. For example, the dimensions of some of the elements may be exaggerated relative to other elements for clarity. Similarly one or several physical components may be included in one functional block or element or divided into more than one functional unit or element. Some of the blocks depicted in the figures may be combined into a single function.

DETAILED DESCRIPTION OF EMBODIMENTS OF THE INVENTION

While this technology is illustrated and described in a preferred embodiment, an ingredient dispensing system for dispensing an ingredient into a container may be produced in different sizes, shapes and colors. This is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

FIG. 1 illustrates an exploded view of an ingredient dispensing system 100 for dispensing ingredient into a material of a container 102, in accordance with a preferred embodiment of the present invention. The ingredient dispensing system 100 communicates with a computing device 104 over a communication network 106. The container 102 includes a neck 108 and stores a material.

The ingredient dispensing system 100 includes a cap 110, a printed circuit board 112, a controller 114, a dispenser 116, a battery 118, a battery holder 120 and a housing unit 122. The cap 110 receives the neck 108 of the container 102. The cap 110 further includes an indent 124 parallel to the neck 108 of the container 102. The cap 110 further includes an ergonometric opening 126.

The printed circuit board 112 is placed on the cap 110 parallel to the indent 124 in the cap 110. The printed circuit board 112 is having a nozzle receiving slot 128. The controller 114 is connected to the printed circuit board 112 and is further programmed to release signals.

The dispenser 116 is connected to the printed circuit board 112 for dispensing the ingredient on receiving the signal from the controller 114. The battery 118 powers the controller 114 and the dispenser 116. The battery holder 120 holds the battery 118 on the printed circuit board 112.

The housing unit 122 is attached to the cap 110 for housing the battery holder 120, the battery 118, the dispenser 116, the controller 114 and the printed circuit board 112. The housing unit 122 includes a compartment 130 for storing the ingredient and a nozzle 132 protruding from the compartment 130 passes through the nozzle receiving slot 128, the dispenser 116 and the neck 108 for transferring the ingredient into the container 102.

The dispenser 116 dispenses to move the ingredient in the compartment 130 through the nozzle 132 into the container 102 on receiving the processed signals from the controller 114. The position of the nozzle 132 and the dispenser 116 is explained in detail in conjunction with FIG. 2 of the present invention.

In accordance with another preferred embodiment of the present invention, the ingredient dispensing system 100 further includes a first sensor 134 connected to the printed circuit board 112. The first sensor 134 is further disposed in the indent 124 of the cap 110 for sensing the material level inside the container 102. The controller 114 receives the sensed signals from the first sensor 134.

In accordance with another preferred embodiment of the present invention, the ingredient dispensing system 100 further includes a second sensor 136 connected to the printed circuit board 112. Further, the second sensor 136 is disposed in the indent 124 for detecting the opening and closing of the ergonometric opening 126 of the cap 110. The second sensor 136 sends the signal to the controller 114.

In another preferred embodiment of the present invention, the controller 114 may further communicates with the computing device 104. The controller 114 receives commands from the computing device 104 to release signals for the output unit 138, the first sensor 134, the dispenser 116, and the second sensor 136. Further, the controller sends the processed signals received from the first sensor 134 and the second sensor 136 to the computing device 104.

In another preferred embodiment of the present invention, the ingredient dispensing system 100 further includes an output unit 138 connected to the printed circuit board 112 for releasing output signals on receiving command from the controller 114. The output unit 138 releases output signals when the detected level of the material inside the container 102 by the first sensor 134 is below then a predefined level of the material inside the container 102 or after a certain pre-defined time stored in the controller 114.

Example of output unit 138 includes but not limited to an audio unit for generating audio signals on receiving reminder signals from the controller 114, one or more light emitting sources connected to illuminate on receiving reminding signals from the controller 114, and a vibration unit to produce vibration signals on receiving reminding signals from the controller 114. Examples of light emitting sources include but not limited to LED, organic lighting and floresecent effect; and examples of audio unit include but not limited to speakers, buzzer, piezoelectric buzzer etc.

Examples of the first sensor 134 includes an optical sensor, a capacitive sensor and an ultrasonic sensor and the examples of the second sensor 136 includes but not limited to touch sensor, a gyro sensor, a vibration sensor, magnetic sensor, optical sensor, and an electro-mechanic sensor.

In a preferred embodiment of the present invention, the usage of the second sensor 136 is to reduce the battery consumption. The second sensor 136 controls the operation profile of the first sensor 134. For exemplary purposes, the first sensor 134 measures the material level only after detection of attaching/detaching of the cap 110 by the second sensor 136.

In another preferred embodiment of the present invention, the ingredient dispensing system 100 further includes a communication unit to communicate with the computing device 104. The wireless communication unit may use various ways of the communication technologies such as wireless technology, near field communication, sonic/ultrasonic technology, or optical technology. Examples of the wireless technology include but not limited to Bluetooth, Bluetooth smart (BLE), Li-Fi, Wi-Fi, ANT, ZigBee, or any other proprietary communication protocol/frequency (band).

Figure 2A:
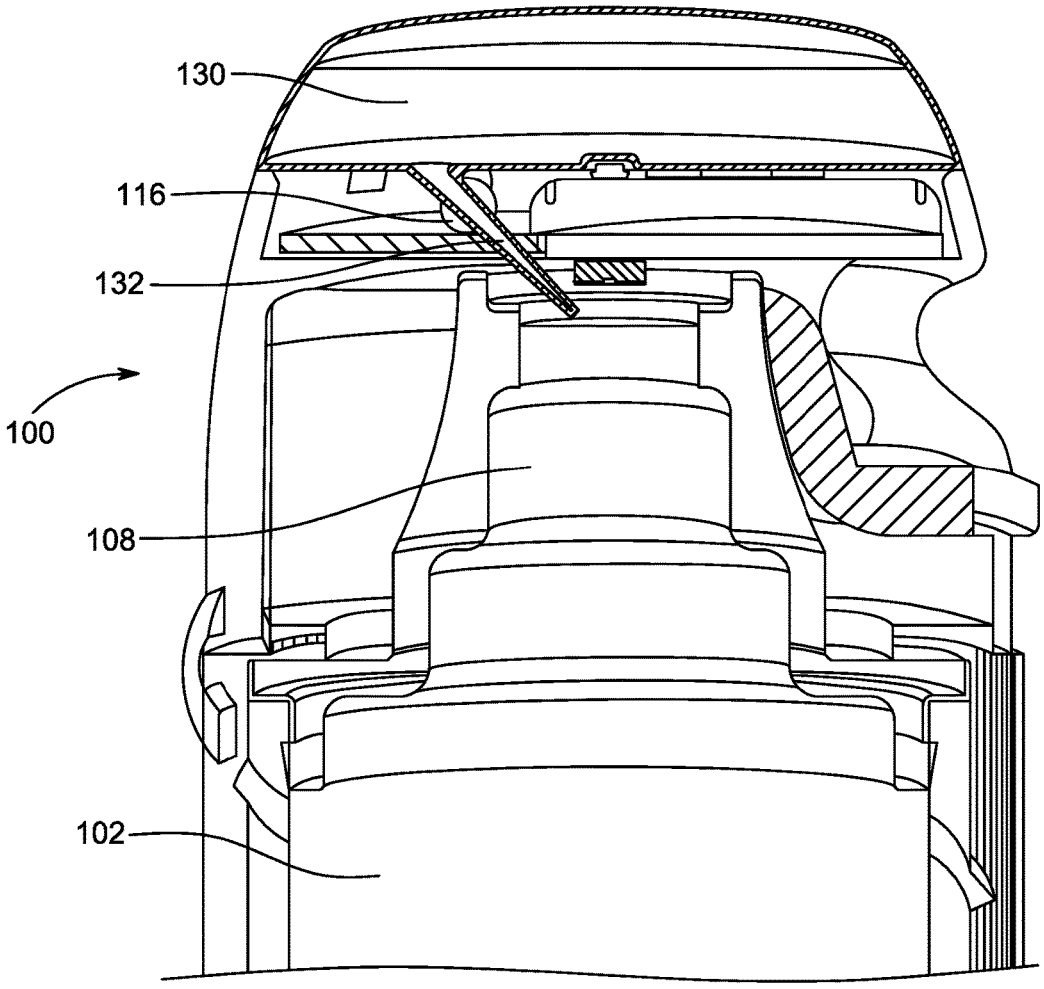
FIG. 2A illustrates a side cross section view of the ingredient dispensing system in accordance with a preferred embodiment of the present invention.

FIG. 2A illustrates a side cross section view of the ingredient dispensing system 100 in accordance with a preferred embodiment of the present invention. The dispenser 116 is an electro-mechanical unit that dispenses to move the ingredient in the compartment 130 through the nozzle 132 through the neck 108 into the container 102.

The dispenser 116 creates a pressure on the nozzle 132 to receive ingredient from the compartment 130 and then further the ingredient passes through the nozzle 132 and is dispensed into the container 102. Examples of the dispenser 116 include but not limited to dispensing pump, electronic controlled valve, MEMS tipping module etc.

Figure 2B:
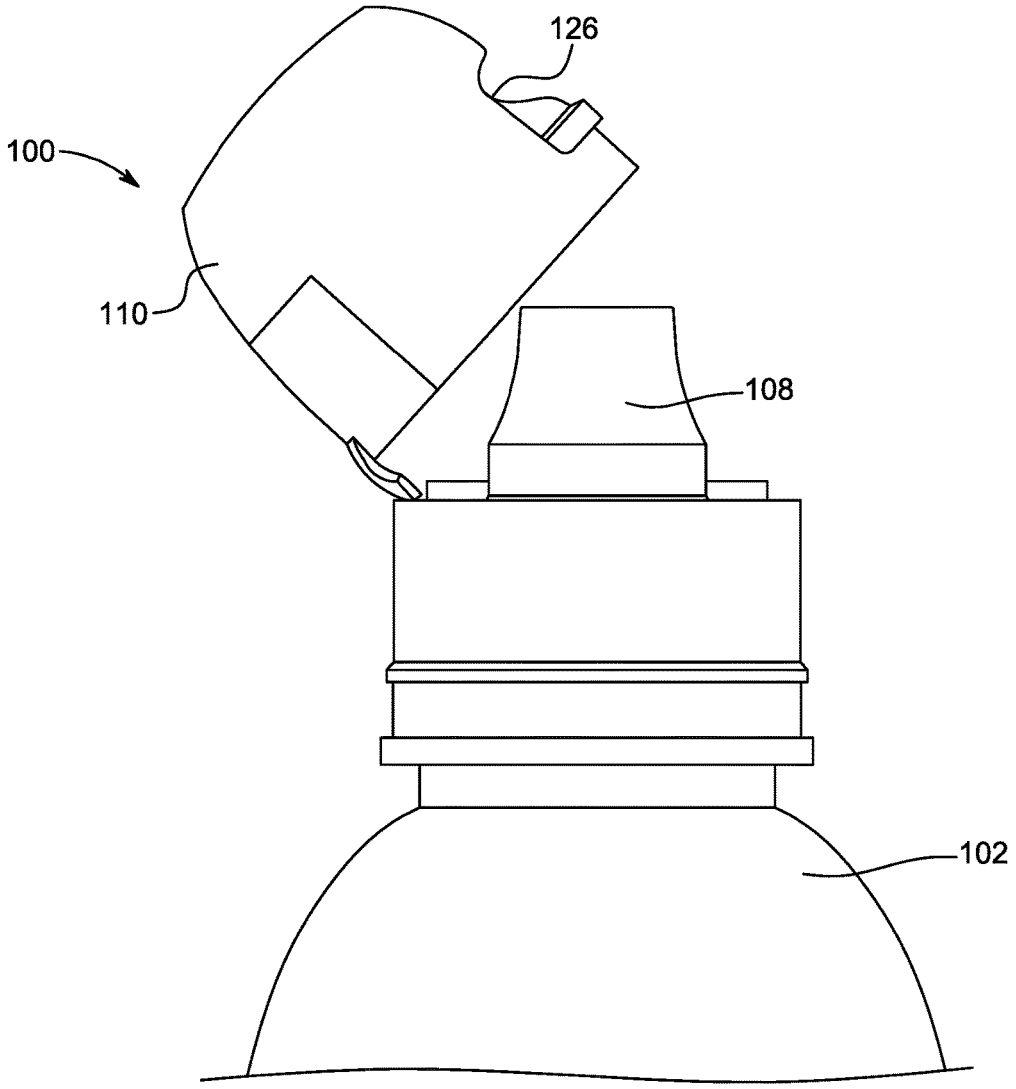
FIG. 2B illustrates a side view of the ingredient dispensing system pivotally attached to the container in accordance with a preferred embodiment of the present invention.

FIG. 2B illustrates a side view of the ingredient dispensing system 100 pivotally attached to the container 102. The ergonometric opening 126 allows a user to remove the cap 110 from the container 102. This allows a user to consume the material through the neck of the container 102.

Figure 3:
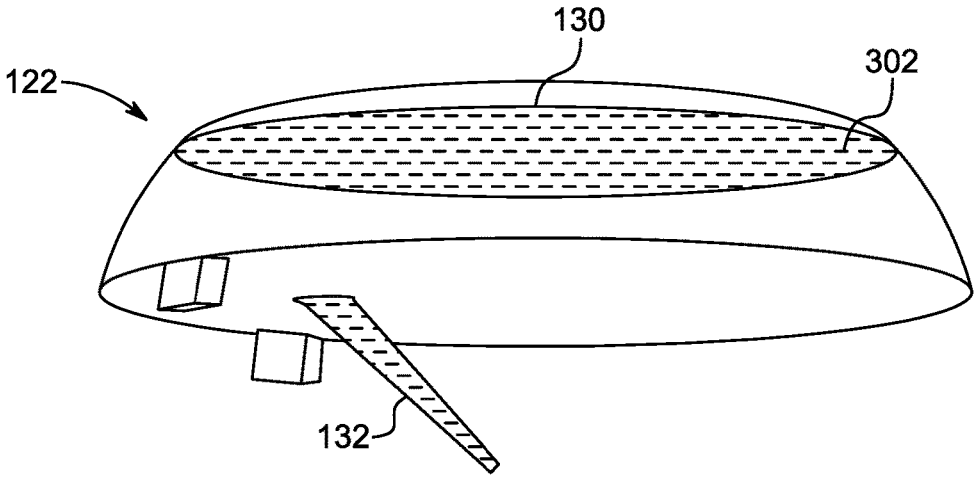
FIG. 3 illustrates a side perspective view of a housing unit in accordance with a preferred embodiment of the present invention.

FIG. 3 illustrates a side perspective view of a housing unit 122 in accordance with a preferred embodiment of the present invention. The ingredient 302 is stored inside the compartment 130. The ingredient 302 moves out through the nozzle 132. Examples of ingredient 302 includes but not limited to medicine, flavors, vitamins, syrup, salts, isotones, food coloring, minerals and nutrients.

Figure 4:
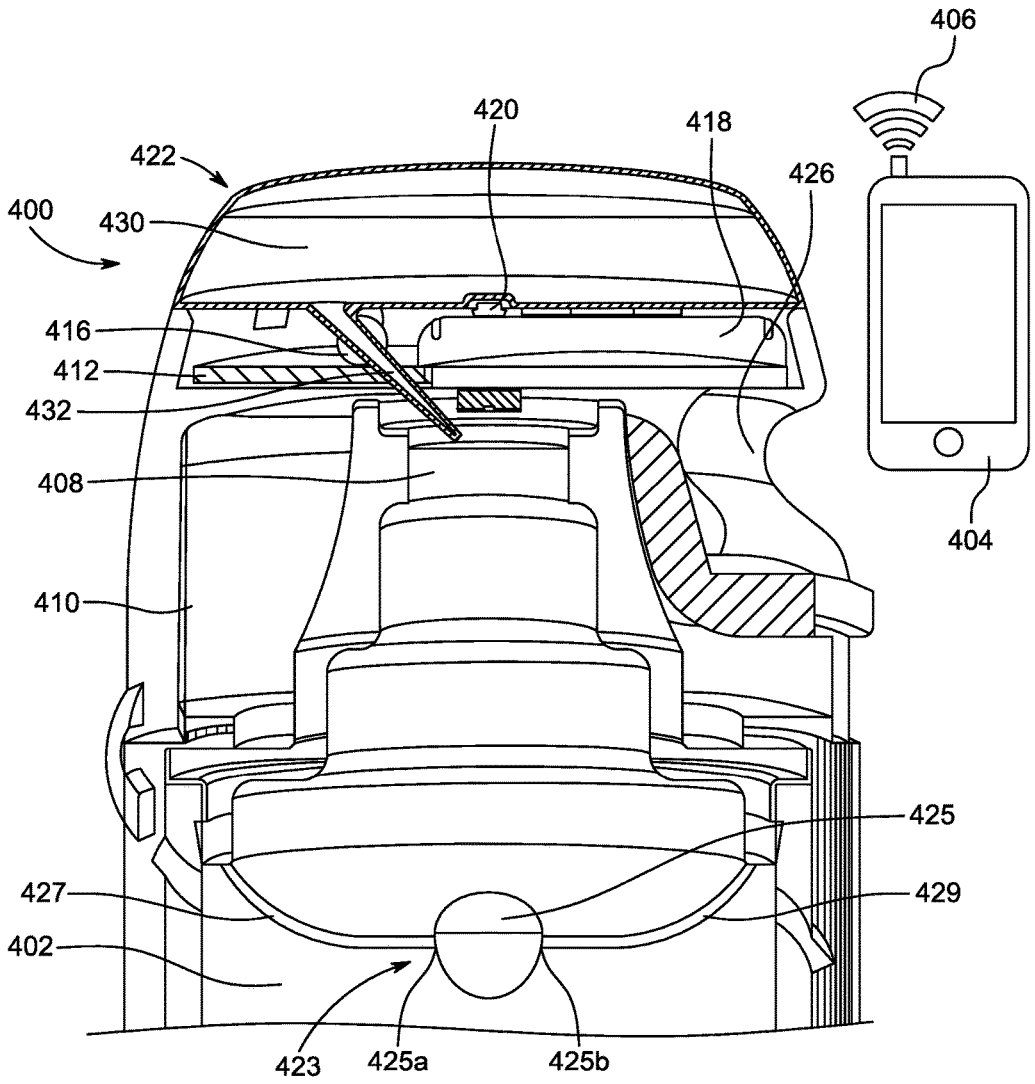
FIG. 4 illustrates a side cross section view of the ingredient dispensing system in accordance with another preferred embodiment of the present invention.

FIG. 4 illustrates a side cross section view of the ingredient dispensing system 400 for releasing ingredient into a container 402 in accordance with another preferred embodiment of the present invention. The ingredient dispensing system 400 communicates with a computing device 404 over a communication network 406. The container 402 includes a neck 408.

The ingredient dispensing system 400 includes a cap 410, a printed circuit board 412, a controller (not shown in FIG. 4), a dispenser 416, a battery 418, a battery holder 420, a housing unit 422 and a collector assembly 423. The cap 410 receives the neck 408 of the container 402. The cap 410 further includes an indent (not shown in FIG. 4) parallel to the neck 408 of the container 402. The cap 410 further includes an ergonometric opening 426.

The printed circuit board 412 is placed on the cap 410 parallel to the indent in the cap 410. The printed circuit board 412 is having a nozzle receiving slot (not shown in FIG. 4). The controller (not shown in FIG. 4) is connected to the printed circuit board 412 and is further programmed to release signals.

The dispenser 416 is connected to the printed circuit board 412 for dispensing the ingredient on receiving the signal from the controller (not shown in FIG. 4). The battery 418 powers the controller (not shown in FIG. 4) and the dispenser 416. The battery holder 420 holds the battery 418 on the printed circuit board 412.

The housing unit 422 is attached to the cap 410 for housing the battery holder 420, the battery 418, the dispenser 416, the controller (not shown in FIG. 4) and the printed circuit board 412. The housing unit 422 includes a compartment 430 for storing the ingredient and a nozzle 432 protruding from the compartment 430 passes through the nozzle receiving slot (not shown in FIG. 4) and the neck 408 for transferring the ingredient into the container 402.

The collector assembly 423 is positioned within the neck 408 of the container 402. The collector assembly 423 includes a collector 425, a first thread 427 and a second thread 429. The collector 425 receives ingredient from the nozzle 432 through the neck 408. The collector 425 is having a first side 425*a* and a second side 425*b*.

The first thread 427 is to connect the first side 425*a* of the collector 425 to the neck 408 and the second thread 429 to connect the second side 425*b* of the collector 425 to the neck 408. The first thread 427 and the second thread 429 maintain the position of the collector 425 parallel to the indent.

Further, the dispenser 416 dispenses the ingredient in the compartment 430 to move through the nozzle 432 into the collector 425 on receiving processed signals from the controller (not shown in FIG. 4). In order to drink, a user tilts the container 402 resulting in tilting of the collector 425 and thus the user consumes the ingredient along with the material.

The purpose of moving the ingredient inside the collector 425 is to avoid the ingredient to get mix with the whole material. The user can easily consume the ingredient with the material without dropping the ingredient into the material. For example, the ingredient is an olive oil which is to be drunk with water but the whole water cannot be mixed with the olive oil and therefore the olive oil is dropped in the container to tilt it slightly on the top layer of the water and to be drunk through the neck 408 of the container 402.

In accordance with another preferred embodiment of the present invention, the ingredient dispensing system 100 further includes a first sensor (not shown in FIG. 4) connected to the printed circuit board 112 for sensing the material level inside the container 402. The controller (not shown in FIG. 4) receives the sensed signals from the first sensor.

In accordance with another preferred embodiment of the present invention, the ingredient dispensing system 100 further includes a second sensor (not shown in FIG. 4) connected to the printed circuit board 112 for detecting the opening and closing of the ergonometric opening 126 of the cap 110. The second sensor sends the signal to the controller (not shown in FIG. 4).

In another preferred embodiment of the present invention, the controller (not shown in FIG. 4) may further communicate with the computing device 404. The controller receives commands from the computing device 404 to release signals for the output unit (not shown in FIG. 4), the first sensor (not shown in FIG. 4), the dispenser 416, and the second sensor (not shown in FIG. 4). Further, the controller sends the processed signals received from the first sensor and the second sensor to the computing device 404.

In a preferred embodiment of the present invention, example of material includes but not limited to water, juices, powder such as coffee, cleaning materials and nutrient supplements etc. Examples of the controller 114 includes but not limited to a microcontroller, a microprocessor, a DSP, ASIC etc. The housing unit 122 and the housing unit 422 are configured according to the shape and size of the cap 110 and the cap 410.

Examples of the communication network 106 and the communication network 406 includes but not limited to NFC, Bluetooth, Bluetooth smart (BLE), Li-Fi, Wi-Fi, ANT, ZigBee, or any other proprietary communication protocol/frequency (band). Examples of near field communication includes but not limited to magnetic NFC, Radio-frequency identification (RFID).

Examples of the computing device 104 and the computing device 404 includes but not limited to mobile, smartphone, iPad, tablets, phablet, smart watch, computer, laptop, a handheld computer, a desktop, a display device or any other computing device capable of wirelessly interacting with our system.

The present invention offers various advantages such as addition of supplements into the diet without needing of the user to go somewhere to bring on the supplements. Also, the present invention offers to take supplements in slow release for better absorption. Further, the present invention reminds the user to take supplements on time and when required.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. An ingredient dispensing system for dispensing an ingredient into a container, wherein the ingredient dispensing system communicates with a computing device over a communication network, and the container includes a neck and stores material, the ingredient dispensing system comprising:

a cap configured to receive the neck of the container, the cap comprising an indent parallel to the neck of the container, the cap comprising an ergonometric opening;

a printed circuit board placed on the cap parallel to the indent in the cap, the printed circuit board having a nozzle receiving slot;

a controller connected to the printed circuit board programmed to release signals;

a dispenser connected to the printed circuit board and configured to dispense the ingredient on receiving the signal from the controller;

a battery to power the controller and the dispenser;

a battery holder for holding the battery on the printed circuit board;

a housing unit attached to the cap for housing the battery holder, the battery, the dispenser, the controller and the printed circuit board, the housing unit comprising:

a compartment for storing the ingredient; and a nozzle protruding from the compartment and passing through the nozzle receiving slot, the dispenser and the neck for transferring the ingredient into the container;

wherein the dispenser dispenses the ingredient in the compartment to move through the nozzle into the container on receiving the processed signals from the controller.

2. The ingredient dispensing system according to claim 1 further comprising a first sensor connected to the printed circuit board and further disposed in the indent of the cap for sensing the material level inside the container, wherein the controller communicates the received sensed signals from the first sensor to the computing device.

3. The ingredient dispensing system according to claim 1 further comprising a second sensor connected to the printed circuit board and further disposed in the indent of the cap for detecting the opening and closing of the ergonometric opening of the cap, wherein the controller communicates the received sensed signals from the second sensor to the computing device.

4. The ingredient dispensing system according to claim 2 further comprising an output unit connected to the printed circuit board for releasing output signals on receiving command from the controller.

5. The ingredient dispensing system according to claim 4 wherein the output unit releases output signals when the detected level of the material inside the container by the first sensor is below then a predefined level of the material inside the container.

6. The ingredient dispensing system according to claim 4 wherein the output unit releases output signals on exceeding a pre-stored time programmed in the controller.

7. The ingredient dispensing system according to claim 6 wherein the controller receives commands from the computing device for releasing signals for at least one of the dispenser; the output unit; the first sensor; and the second sensor.

* * * * *